US005330199A

United States Patent [19]

Vand

[11] Patent Number: 5,330,199

[45] Date of Patent: Jul. 19, 1994

[54] BALL ACCURACY TARGET

[76] Inventor: Ebrahim F. Vand, P.O. Box 202350, Austin, Tex. 78720

[21] Appl. No.: 57,894

[22] Filed: May 7, 1993

[51] Int. Cl.[5] ..... A68B 63/04

[52] U.S. Cl. ..... 273/400

[58] Field of Search ..... 273/398, 400, 401, 402, 273/411, 354, 1.5 R

[56] References Cited

U.S. PATENT DOCUMENTS

| | | | |
|---|---|---|---|
| 3,467,388 | 9/1969 | Weiler | 273/400 X |
| 4,109,910 | 8/1978 | Gleason | 273/DIG. 25 X |
| 4,762,319 | 8/1988 | Krumholz | 273/400 X |
| 4,842,284 | 6/1989 | Rushing et al. | 273/411 |
| 5,048,844 | 9/1991 | Haseltine | 273/411 X |

*Primary Examiner*—William H. Grieb

[57] ABSTRACT

An annular netted target (8) that can rotate to different angles as well as to different heights. The target will assist in the teaching and drilling of ball placement skills that are essential to a player when playing a field or court sport. The invention will also assist the physical education teacher or coach who must teach several students at one time, all with different skill and interest levels.

The Ball Accuracy Target is lightweight, easily assembled, disassembled, transported and stored. The target's angle is changed by simply rotating a screw(15). The height is controlled by extending and compressing telescopic poles (18, 18*a*, 18*b*, 18*c*) that are anchored in place with a slip joint nut (20, 20*a*, 20*b*). The target can be free standing on a variety of surfaces: a stake base (22) will attach to a ground surface, a flat base (24) will attach to an indoor/outdoor carpet surface, and a suction base (26) will attach to a gymnasium floor.

5 Claims, 3 Drawing Sheets

BALL ACCURACY TARGET

FIELD OF INVENTION

This invention relates to sports training equipment, more specifically, to the teaching and practicing of ball sports, preferably soccer, where the placement of the ball is crucial and must be taught and practiced.

BACKGROUND -DESCRIPTION OF PRIOR ART

In soccer, ball control and ball placement is crucial to achieve scoring into the goal. Heretofore when teaching the proper placement of the ball, that is necessary during actual soccer play, a traditional goal is used. The goals, although sold in various sizes, do not provide a more specific target. The traditional goal is large and permanent. Although the Portable Rebounding Soccer Training Goal patent 5,048,844 issued to Haseltine Sep. 17,1991 is portable it does not provide specific target capabilities. Within the scope of Haseltine's patent the size could be changed to specify a target but it would be manufactured in that configuration and could not be adjustable. Soccer Two Way Goal patent 4,842,284 issued to Rushing et al. Jun. 27, 1989 is a smaller goal providing some degree of target capabilities, however it is not adjustable, and therefore does not provide for players of various skill levels. The Rushing patent is a lightweight, easily transported goal, however it is limited to an outdoor playing field. Currently all available soccer training devices are made to attach to the ground, thus rendering them useless for practice or instruction in an indoor gym.

OBJECTS AND ADVANTAGES

Accordingly, several objects and advantages of the Ball Accuracy Target are:

a) It has a limited target area for the student to perfect his ball placement skills.

b) The target rotates 360 degrees and the frame adjusts up and down allowing for practice of different skills, not only forward goal shots, but also drop balls and positioning shots that are needed in play.

c) It can be secured to the ground outside, but also will attach to a gymnasium floor or a carpeted gym floor.

d) The target and framework is composed of a plurality of members, which are lightweight and collapsible, are easily assembled, disassembled, stored and highly portable.

e) It can be used by an individual to practice his skills or several students at the same time.

f) It will be used preferably in soccer but would be useful in all field ball sports where placement of the ball is essential.

Further objects and advantages are to provide a device that will assist a teacher or coach instructing several students with different levels of skill and interest. Players can be placed on both sides of the target and practice concurrently. The target can be used as a goal for actual play in an instructional soccer game.

DRAWING FIGURES

In the drawings, closely related parts (functionally) have the same reference number but different alphabetical suffixes.

Figure 1:
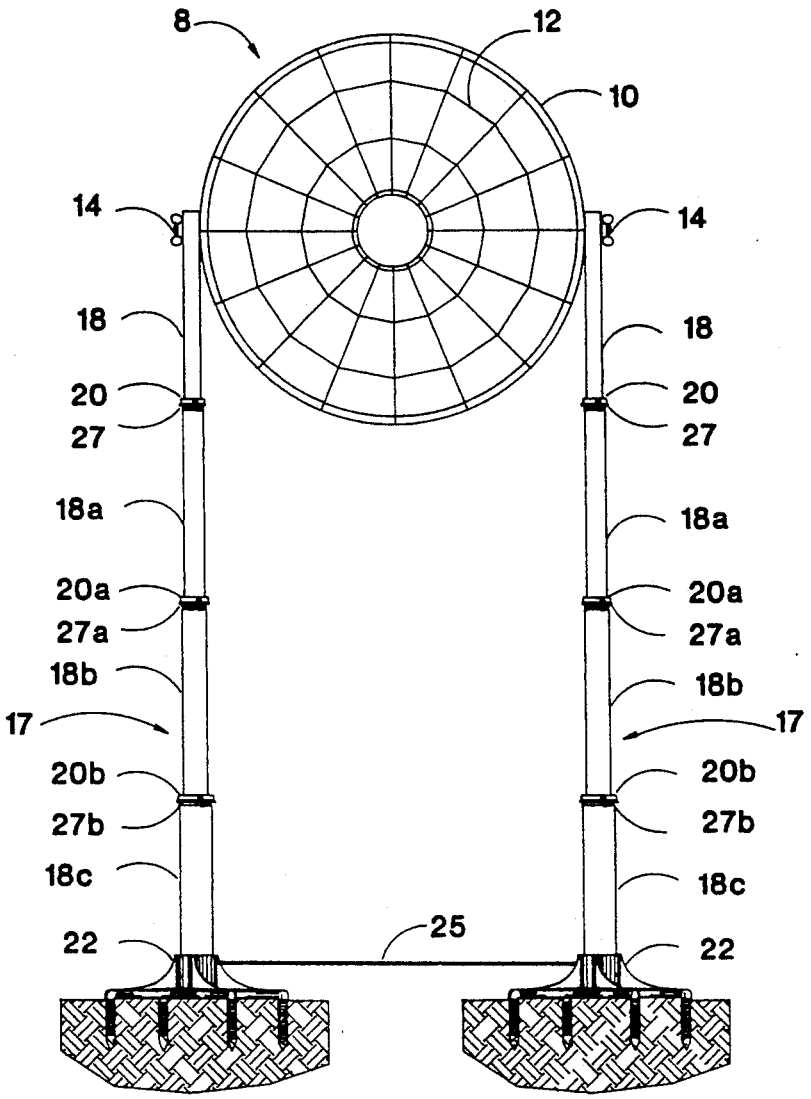
FIG. 1 shows a comprehensive view of a Ball Accuracy Target, with a maximum upward elongated support, and a target perpendicular to the ground.

| Reference Numerals In Drawing | |
|---|---|
| 08 | target |
| 10 | net ring |
| 12 | net |
| 14 | wing nut |
| 15 | octagon shouldered screw |
| 16 | octagon hole |
| 17 | frame |
| 18 | top elongated pole |
| 18 a, b, c | elongated support poles |
| 20, 20 a, b | slip joint nuts |
| 22 | stake base |
| 24 | flat base |
| 25 | measurement cord |
| 26 | suction base |
| 27, 27 a, b | washer |

DESCRIPTION FIGS. 1,3,4,5

Referring to FIG. 1 A typical target 8 comprises a net 12 suspended within a net ring 10. The net 12 is formed of elastic or other suitable material. Ring 10 preferably takes a small round solid tubular shape that forms an annular hoop. Elongated support poles 18, 18*a*, 18*b*, 18*c*, slip joint nuts 20, 20*a*,20*b*, washers 27, 27*a*,27*b*, and stake base 22 comprise the frame 17. Poles 18, 18*a–c* comprise four hollow cylindrical telescopic tubes. Top pole 18 typically has a closed fiat top surface, an opened bottom end, is the longest of the four poles and has the smallest cylindrical diameter. Pole 18*a* is open at both ends, has male threading at the top, is shorter and has a slightly larger cylindrical diameter than pole 18. Pole 18*b* is open at both ends, has male threading at the top, is shorter and has a slightly larger cylindrical diameter than pole 18*a*. Pole 18*c* is open ended at the top and has a closed fiat bottom surface. Pole 18*c* has male threading at the top, is shorter and has a slightly larger cylindrical diameter than pole 18*b*. Pole 18*c* fits snuggly into stake base 22. A measurement cord 25 is a light weight rope or similar material that is attached to the stake bases 22. The frame parts are preferably composed of lightweight, high quality, weather resistant plastic or other suitable material.

Figure 3:
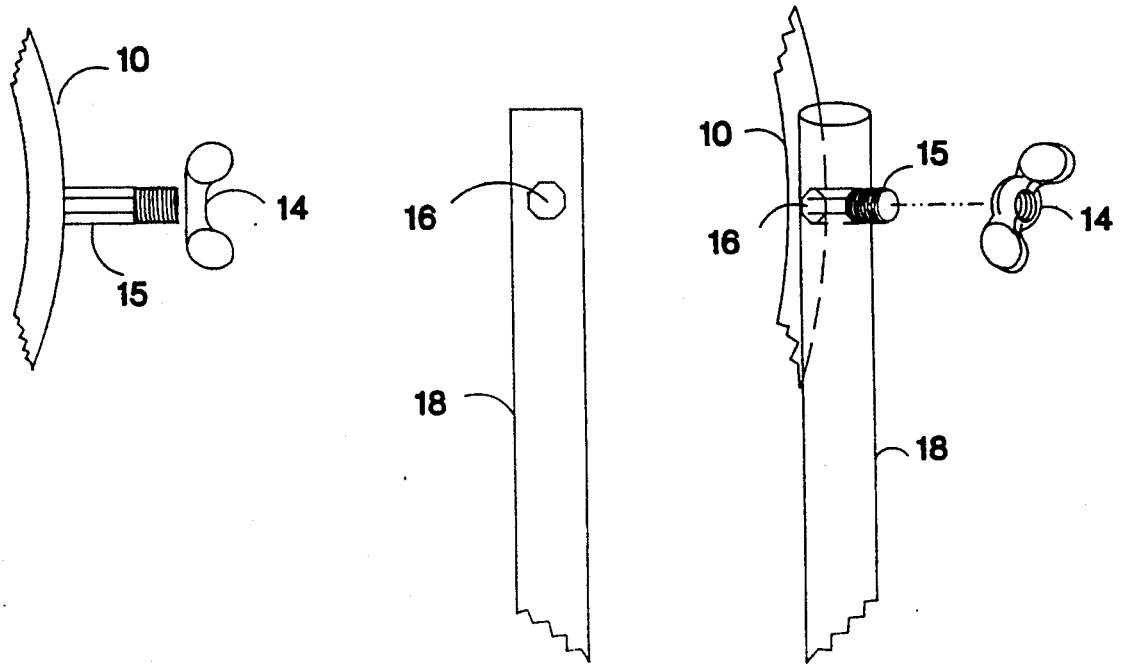
FIG. 3 shows a magnified view of an octagon shouldered screw mounted on the net ring, a wing nut and a top elongated support pole.

Referring to FIG. 3 protruding from the ring 10 at opposite axes are two permanently mounted octagon screws 15. Screw 15 is a two shaped component. From the base of ring 10 extending the width of pole 18 screw 15 is a polygon with eight equal sides, one centimeter in diameter. Screw 15 continues with sufficient threading for the nut but with minimal protrusion. Slightly below the top of pole 18 is an octagon hole 16 that passes thru the width of the pole 18 and is diametrically aligned to the octagon shape of screw 15. Screw 15 has male thread that mates with the female thread of the provided wing nuts 14.

Figure 4:
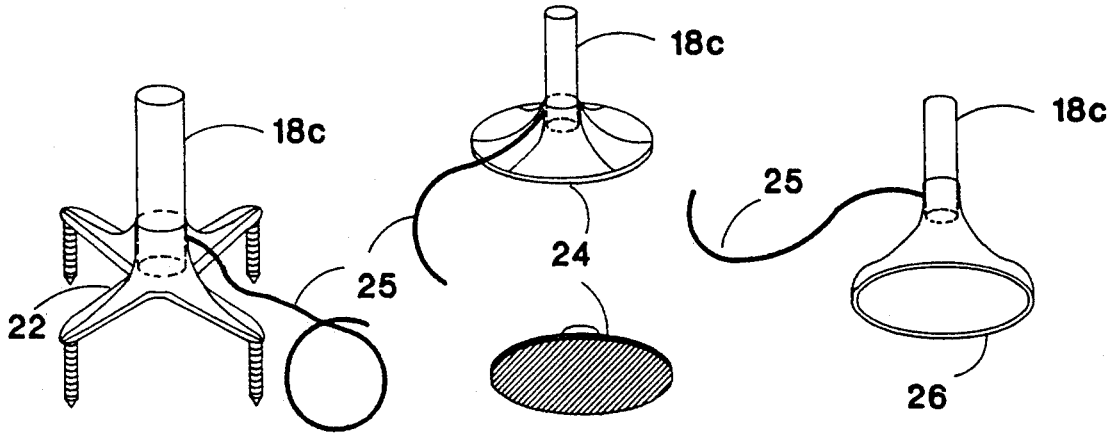
FIG. 4 shows a comprehensive view of a stake base, a flat base and a suction base.

Referring now to FIG. 4 a staked base 22 typically takes the shape of four elongated prongs, perpendicular from pole 18*c*, with sufficient length to prevent tip over, a flat bottom surface, and adjacent ends forming right angles. At the center point at which the four prongs meet is an upwardly protruding hollow cylinder with an annular socket diameter slightly larger than pole 18*c*. At the end of each prong protruding perpendicular downward is a stake with a spiral grove and a sharp pointed tip. A fiat base 24 typically comprises a circular disc with a flat bottom surface provided with a hook and loop fastening configuration. An upwardly protruding hollow cylinder with an annular socket diameter slightly larger than pole 18*c* is centered on top of the disc. A suction 26 base comprises a hollow dome shape with a wide base. The plunger type attachment is made up of soft rubber or other suitable material. Centered on the top outside of the dome is an upwardly protruding hollow cylinder with an annular socket diameter slightly larger than the pole 18*c*. A Measurement cord 25 connects each similar base attachment.

Figure 5:
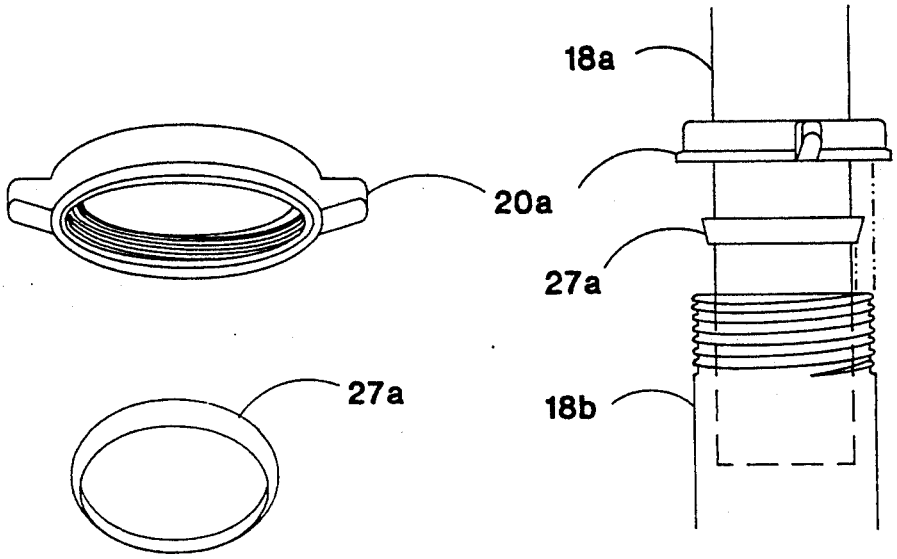
FIG. 5 shows a magnified view of a elongated support pole with a slip joint nut and washer.

Referring to FIG. 5 joint nuts 20*a* with female threading and washers 27*a* are diametrically aligned to their respective pole 18*a,b*. Outside of joint nuts 20*a*, on opposite ends are thumb size tabs.

OPERATION FIGS. 1 THRU 6

In the operational description the skills of soccer will be used to demonstrate the invention, however this is not to limit the scope of the invention to the sport of soccer, as this invention is used in the practice of all field/court sports where the placement of the ball is crucial.

Figure 6:
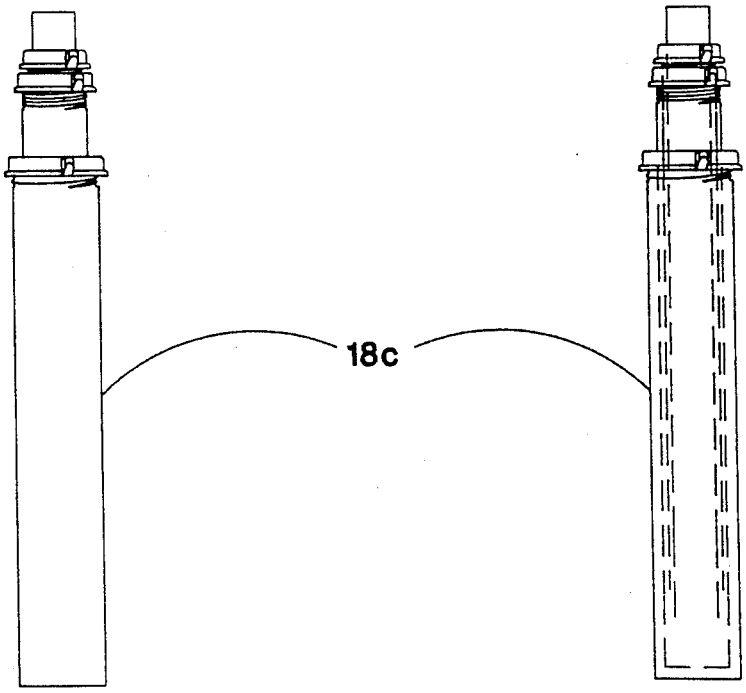
FIG. 6 shows a comprehensive and x-ray view of elongated support poles removed from the target and compacted.

The invention is easily transported to the desired practice area and assembled. The base attachments will secure the invention on several different surfaces. Referring to FIG. 4 stake 22, is used on ground, flat 24 is used on a gym floor covered with indoor/outdoor carpet and the suction 26 is used on a traditional gym floor or similar surface. The following steps would be followed to assemble the invention as illustrated in FIG. 1. The stakes 22 are secured into the ground by applying pressure to the top of the prongs. The attached measuring cord 25 indicates the required distance between the stakes 22. The poles are assembled while compacted FIG. 6, by securing pole 18*c* into the annular socket of base 22 creating a tightly snug fit; repeat this step for the opposite side of the frame. Several different heights are available by extending one or more poles 18,*a,b* upward and anchoring the position with the respective joint nut 20, 20*a,b* and washer 27, 27*a,b*. Referring to FIG. 5 as the poles are slightly different sizes to allow them to slip into each other and compact, a washer 27*a* is necessary to allow the joint nut 20*a* to fit over both poles 20*a,b* securing the position. The tab on the joint nut 20*a* makes turning the joint nut 20*a* by hand and anchoring the desired position easy. FIG. 3 demonstrates the final step in setting up: attaching the target 8 and adjusting to the desired angle. The target 8 rotates 360 degrees at 45 degree increments. The octagon screws 15 are put through the holes 16 in the top poles 18. The target is then secured by tightening the wing nut 14. The octagon shape of the screw 15 and the hole 16 control the angle of the target. By removing the target 8 from the poles 18 and matching different surface edges of the octagon hole 16 and screw 15 a different angle is achieved. The octagon screw provides built in repeatable settings. The target must be secured by the wing nut 14 each time the angle is adjusted. Once the target is assembled, changing the height and angle to practice different skills is simple. Loosening the joint nut 20,20*a,b* and adjusting the poles 18,*a,b* or loosening the wing nut 14 and adjusting the angle allows for a many target choices. Disassembly and storage are accomplished by reversing the order of assembly.

Figure 2:
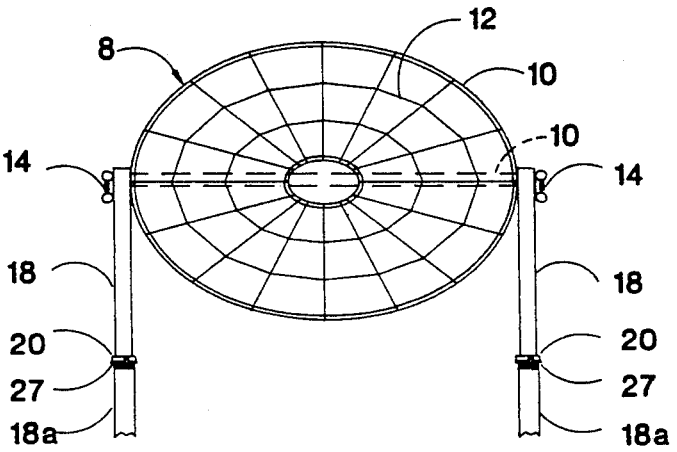
FIG. 2 shows comprehensive view of an upper target with a net in two positions: a 45 degree angle and (dashed lines) a net positioned parallel to the ground.

Typically a physical education teacher or coach would use this invention to demonstrate and drill the soccer skills that would accompany a soccer curriculum. A class with a variety of interested or skilled players could use this invention regardless of their ability. The players with little or no skill could set up the Target on the lowest position with the net 12 perpendicular to the ground and simply kick the ball back and forth to each other. Referring to FIG. 2 the more adept athlete could angle the target to 45 degrees to practice a forward shot or move it parallel to the ground and practice drop shots, head and chest control. The target would also be used as the goal if an instructional soccer game was played.

The inventor believes, but does not wish to be bound by, the asthetic value of a circular target. It is much more common to shoot at a basketball hoop in a backyard. The inventor believes the circular target would encourage practice and therefore would be a valuable backyard addition.

SUMMARY, RAMIFICATION AND SCOPE

Accordingly, the Ball Accuracy Target can be instrumental in the teaching and practicing of ball placement. It is designed for soccer, football and baseball practice, however it can be easily adapted to any sport regardless of the mode by which the ball is moved. Furthermore, the target has the additional advantages in that

- it can be used by one individual or by a group of students;
- it has a limited target area for the student to perfect his ball placing skills;
- it provides a 360 degree target choice and the frame provides many vertical positions to set up different targets for practicing various ball placement skills;
- it has different base attachments to allow it to be free standing staked into the ground, suctioned to a gymnasium floor or adhered to a carpeted gym floor; and
- it is lightweight and quickly assembled and disassembled allowing it to be simple to use, highly portable and easily stored;
- the target can be used as a goal in an instructional soccer game.

Although the above description contains specifications, these should not limit the scope of the invention but rather should be taken as illustrations of the more primary functions. For example; the target and or net can be in many different shapes or sizes; the elongated support poles can raise or lower the target in many different ways; the rotation of the target can be accomplished in various manners and the materials used to construct the invention can greatly vary.

Thus the scope of the Ball Accuracy Target should be determined by the appended claims and their legal equivalents, rather than the examples given.

What is claimed is:

1. A ball control practice device comprising;

a) a target including a net secured within an annular hoop;

b) an octagon screw protruding outward on both axes mounted on said annular tube;

c) a pair of elongated poles with an octagon hole extending the width of each pole and diametrically aligned with said octagon screw;

d) a wing nut with thread means mating with the thread means of said octagon screw;

e) frame base attachments having upper and lower portions;

f) attachment means for attaching said target to said elongated poles, including means for permitting said target to rotate 360 degrees in 45 degree intervals;

g) means by which said elongated poles with said target attached are attached to the upper portions of said frame base attachments;

h) means for permitting vertical adjustment of said targets; and i) said lower portions of said frame base attachments having means to secure said practice device to a playing surface.

2. The ball control prance device of claim 1, wherein the lower portions of said frame base attachments comprise four horizontally disposed elongated prongs forming right angles perpendicular to said telescopic poles, said prongs having grooved sharp tips extending perpendicular downward from prongs, by which said device is secured to a ground playing surface.

3. The ball control practice device of claim 1, wherein lower portions of said frame base attachments comprise flat circular discs having means to secure said practice device to a carpeted playing surface.

4. The ball control practice device of claim 1, wherein the lower portions of said frame base attachments comprise suction cup means to secure said practice device to a smooth playing surface.

5. The ball control practice device of claim 1, wherein said elongated poles are each comprised of a plurality of pole sections telescopically engaged together.

* * * * *